United States Patent [19]

Chew

[11] 4,285,674

[45] Aug. 25, 1981

[54] FLOAT ATTACHMENT FOR A BICYCLE

[76] Inventor: Thomas S. Chew, 2319 11th Ave., Oakland, Calif. 94606

[21] Appl. No.: 46,453

[22] Filed: Jun. 7, 1979

[51] Int. Cl.[3] ..... B63H 1/00; B63H 16/12

[52] U.S. Cl. ..... 440/12; 440/26

[58] Field of Search ..... 115/25, 26, 27, 2, 70; 440/26, 21, 30, 12

[56] References Cited

U.S. PATENT DOCUMENTS

| | | | |
|---|---|---|---|
| 619,818 | 2/1899 | Young, Jr. | 115/2 |
| 2,296,147 | 9/1942 | Cremer | 440/26 |
| 2,757,631 | 8/1956 | Truter | 440/26 |
| 3,388,908 | 6/1968 | Ruck | 115/70 |

FOREIGN PATENT DOCUMENTS

| | | | |
|---|---|---|---|
| 16853 | 9/1892 | France | 115/26 |
| 377214 | 6/1964 | Switzerland | 115/26 |

*Primary Examiner*—Trygve M. Blix
*Assistant Examiner*—Jesús D. Sotelo
*Attorney, Agent, or Firm*—Owen, Wickersham & Erickson

[57] ABSTRACT

An attachment for a bicycle is disclosed, permitting use of the bicycle in water, with relatively efficient propulsion and steering, and also on land, without removal of the attachment. Floats of the attachment are positioned on either side of the bicycle, connected by frame members which are removably attached to forward and rearward portions of the bicycle frame. The front wheel of the bicycle is provided with a solid circular disc, closing the space within the rim, so that the front wheel acts as a rudder in water when steered. Connected to the rear wheel spokes are a series of impeller cups or vanes which strike the water in the bottom of their stroke of movement to drive the bicycle forward. The floats may be of a lightweight foam material, or may be inflatable. For use as an exercising device, the bicycle may be provided with a resistance device engaged against the rear wheel, and the bicycle may be elevated on blocks, via the floats.

2 Claims, 5 Drawing Figures

FIG.1
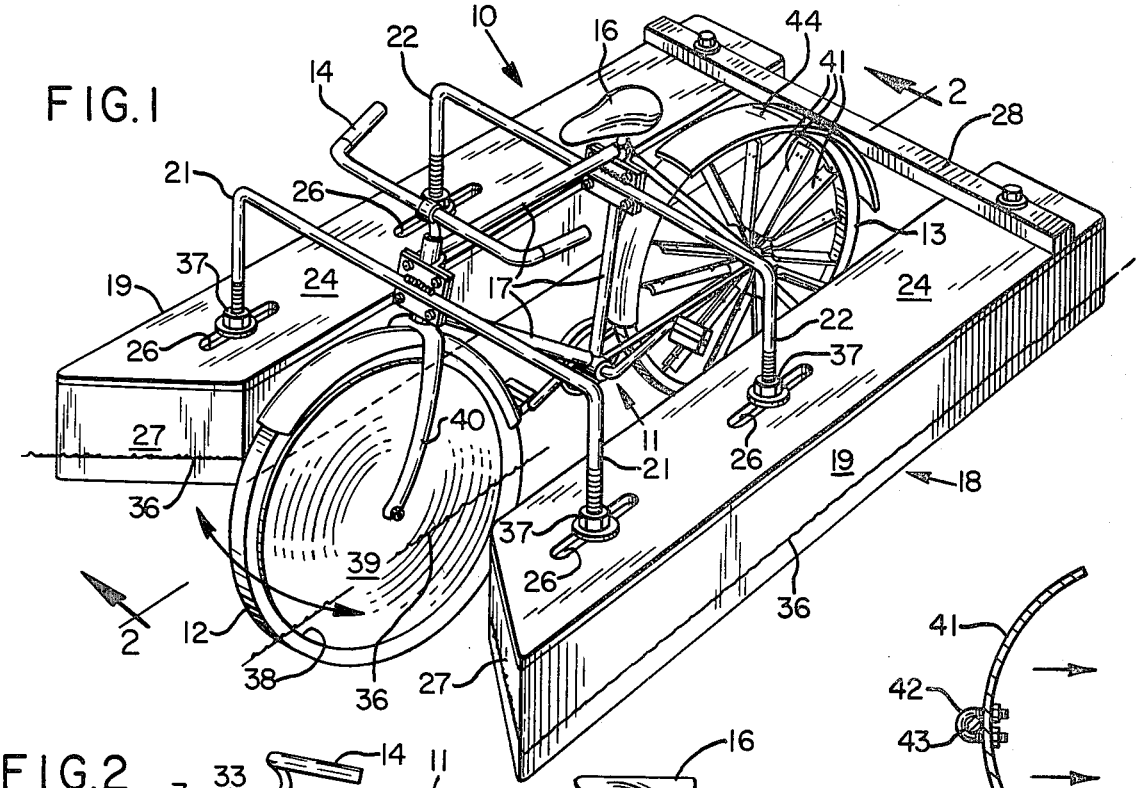
FIG.2
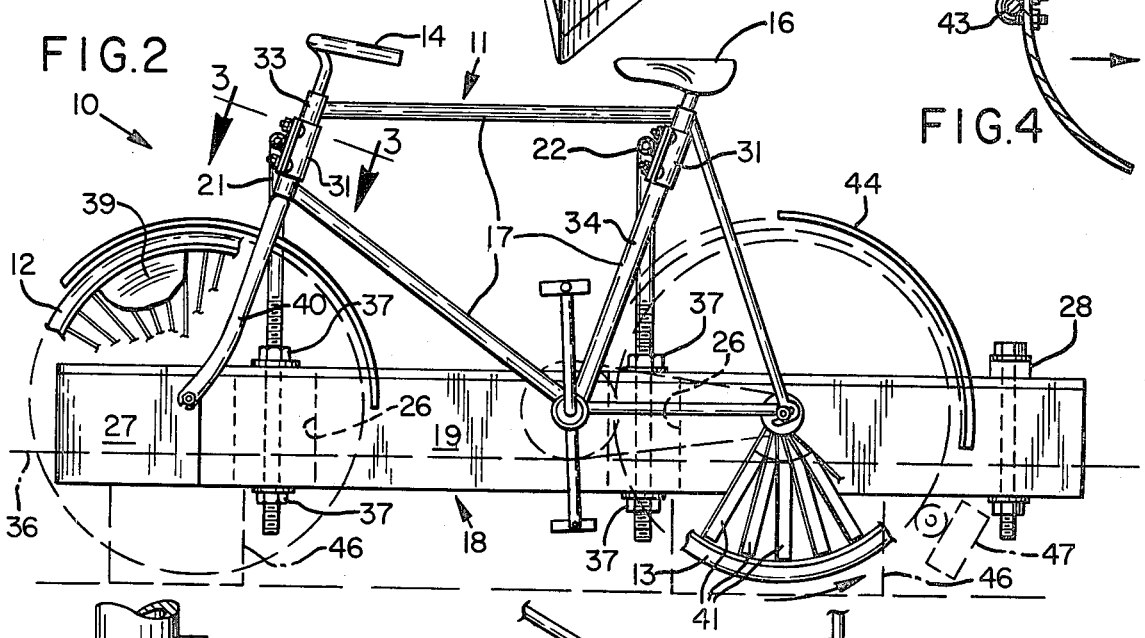
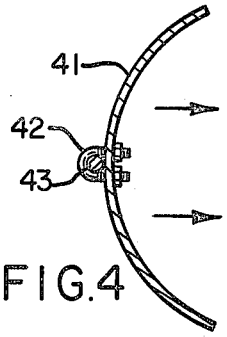
FIG.4
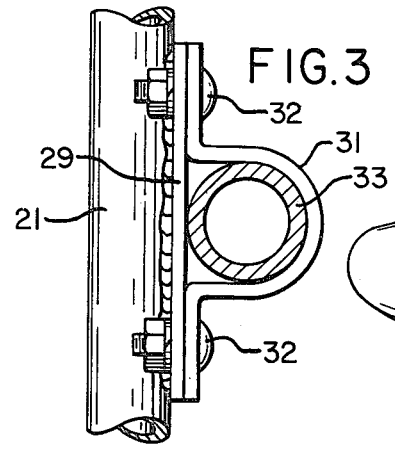
FIG.3
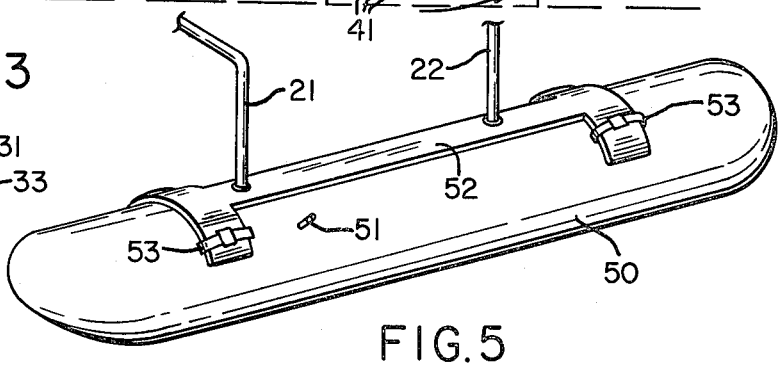
FIG.5

FLOAT ATTACHMENT FOR A BICYCLE

BACKGROUND OF THE INVENTION

The invention relates to vehicles, and more particulary to an amphibious bicycle and an attachment to a conventional bicycle, of any of various types and sizes, for making it amphibious.

A wide variety of different types of floating bicycles and float attachments for bicycles have previously been suggested. These apparatus have used various types of propulsion means for the bicycle while in the water, nearly always connected in some fashion to be driven by pedalling. In many of the prior devices, a ruddering device was connected to the front wheel or front wheel steering fork. See, for example, Petroskey U.S. Pat. No. 3,640,239; Vigo U.S. Pat. No. 2,323,261; Payette U.S. Pat. No. 799,667; Hartlett U.S. Pat. No. 839,476; and Munsen U.S. Pat. No. 1,034,278. Petroskey shows a float attachment for a conventional bicycle, connected to the bicycle by means of the front and rear wheel axles. The front wheel of the bicycle is provided with a rudder which is attached to the bottom of the front wheel for water operation, and this rudder has its own steering axis and a cable for operating it rather than being controlled by steering of the handlebars. Propulsion is provided via a separate shaft extending between a rear pair of floats, with paddles on the shaft driven by connection to the rear sprocket of the bicycle. While appearing effective for water operation, the Petroski apparatus did not provide for land operation of the bicycle with the marine apparatus attached, and the floating bicycle was not easily converted back to conventional use.

Vigo disclosed a floating bicycle having circular floats instead of bicycle wheels. A rudder was connected to the front wheel steering fork, operable by use of the handlebars.

Hartlett shows a type of floatable bicycle having paddles connected to the spokes of the rear wheels, for propelling the floating bicycle by means of the pedals. Munsen shows a bicycle intended for amphibious use, having front and rear floats which could be swung upwardly when the bicycle was to be used for land operation.

No previous floating bicycle known to the applicant has been useable on either land or water without adjustment or modification when going from one mode to the other. In addition, no prior device has included a float device which is as easily removable as that of the present invention. Moreover, no prior water bicycle or amphibious bicycle has been as efficient in design as the present invention, taking advantage of the existing components of a bicycle to the extent of the amphibious device described below.

SUMMARY OF THE INVENTION

The present invention is a totally amphibious bicycle, or amphibious attachment for a bicycle, which enables the entire apparatus to be used either in water or on land with no adjustment or modification. Although the bicycle can be operated on land without removal of the floating attachment, the attachment can be disconnected in a matter of a few minutes if desired. The steering and propulsion arrangements never need be removed, but can also be disconnected if desired. Bicycles with the amphibious attachment have been used in water and have proven efficient and reliable.

The float attachment preferably includes a pair of lightweight foam or inflatable floats spaced apart for positioning on either side of the bicycle, with at least two frame members extending between the floats and connectable to frame components near the front and rear of the bicycle. The bottoms of the floats remain above the wheel bottoms at all times, but are positioned somewhat below the hubs of the wheels.

For guiding the amphibious device as a marine vehicle, the front wheel has a solid circular disc attached to close the normally open area defined by the annulus of the wheel rim. Thi disc may be secured to the spokes, and need not be taken off since it is lightweight and not cumbersome or unattractive. In the water, the wheels are partially submerged, to a point preferably somewhat below the hubs, so that the front wheel has an adequate ruddering effect and the back wheel has adequate propulsion capability.

Propulsion is provided by a series of impeller cups or vanes associated with the rear wheel, and preferably secured to the spokes. These may be elongated vanes extending most of the length of the spokes.

If the floats are of a rigid foam material, the forward ends may be tapered in such a way as to both provide for reduced water resistance and to provide space for steering operation of the front wheel.

Accordingly, in one embodiment an amphibious attachment for a bicycle according to the invention comprises float means having two sides spaced apart to accommodate the bicycle frame and wheels between them; frame means for mounting the float means securely on the bicycle frame, at a height above the bottoms of the wheels; a solid circular disc and means for mounting it substantially flushly on the front wheel, so that the front wheel becomes a steerable rudder; and a series of impeller vanes and means for mounting them on the rear wheel, so that the rear wheel becomes a driving means; whereby with the attachment secured, the amphibious bicycle may be used in a normal manner on land, and may be used in water, suspended by the float means with the front and rear wheels partially submerged, so that the bicycle may be propelled by pedalling and steered by steering of the front wheel.

It is therefore among the objects of the invention to provide an amphibious bicycle, or an amphibious attachment for a bicycle, having the advantages of being lightweight, simple in construction, efficient in use and capable of use on land or in water without adjustment or modification. These and other objects, advantages and features of the invention will be apparent from the following description of a preferred embodiment, taken in conjunction with the accompanying drawings.

DESCRIPTION OF THE DRAWINGS

FIG. 1 is a perspective view showing a conventional bicycle having the apparatus of the invention attached to provide an amphibious vehicle.

FIG. 2 is a side elevation view of the amphibious bicycle apparatus also showing the apparatus elevated on blocks for use as an exercising device.

FIG. 3 is a detail view taken along the line 3—3 of FIG. 2, showing the manner of connection of the float frame with the bicycle.

FIG. 4 is a view showing in section an impeller vane secured to a spoke on the rear wheel of the bicycle.

FIG. 5 is a partial view showing an alternative embodiment of a float member.

DESCRIPTION OF THE PREFERRED EMBODIMENTS

In the drawings, FIG. 1 shows an amphibious bicycle 10 including a conventional bicycle 11, which may be of various different well-known types, in various sizes, having a steerable front wheel 12 and a chain driven rear wheel 13, as well as handlebars 14 and a seat 16, all connected to a frame 17. Connected to the bicycle 11 is a float attachment 18, comprising a pair of spaced apart elongated floats 19 and frame members 21 and 22 secured to the floats and extending between them as indicated. Each float may be comprised of a rigid, lightweight, low-density foam material, and in this case some form of rigid surface member 24 may be secured to the top of each float. The frame members 21 and 22 may be connected by threaded fasteners as shown, or other suitable means for attachment to the floats may be used. As indicated, slots 26 are preferably provided, in the case of a threaded fastener connection, for adjustment of the positions of the frame members 21 and 22.

The front ends of the floats 19 preferably include a taper 27 as shown, so that resistance to movement through the water is reduced. The illustrated taper 27, extending rearwardly and inwardly in a single plane, also permits the floats 19 to be fairly close together yet still provide ample room for steering of the front wheel.

The float attachment 18 also preferably includes some form of stabilizer at the rear, such as the stabilizing bar 28 shown in the drawing, rigidly connecting the rear ends of the two floats and being positioned above the water.

The float attachment 18 may be connected to the bicycle by any suitable means, but the means employed is preferably one permitting easy detachment in case this is desired. For example, such securing means may comprise, as shown in FIGS. 1, 2 and 3, a plate 29 affixed centrally to the frame member 21 or 22, as by welding, and U-bolts or a u-shaped connector 31, with threaded fasteners 32, for plate engagement around the front fork steering sleeve 33 of the frame 17 of the bicycle, in the case of the forward float frame member 21, and around a generally upright frame member 34 of the bicycle, just below the seat 16, in the case of the rear float frame member 22. Alternatively, the connection between the frame member 21 or 22 and the steering fork sleeve 33 may be adjustable to accommodate steering fork sleeves oriented at different angles of inclination, as on different types of bicycles. To this end, the plate 29 may be secured to a sleeve (not shown) which fits over the frame member 21 or 22, with a set screw (not shown) preventing relative rotation of the sleeve on the frame member 21 or 22. Alternatively, the plate 29 may be eliminated and a pair of U-bolts may be secured, around the member 21 or 22, to the U-shaped connector 31, affording the required adjustability.

When in water, the amphibious bicycle apparatus 10 is very stable, with the spaced-apart floats 19 extending just a few inches below the water line 36 as indicated. The floats 19 are positioned at appropriate level with respect to the bicycle 11 such that the front and rear wheels 12 and 13 extend somewhat less than half way into the water, approximately as indicated. The level of the floats may be made adjustable through the provision of threaded adjustable connecting means 37 as illustrated.

As discussed above, the front wheel 12 of the bicycle includes some means of closing or substantially closing the space interior of the wheel rim 38, such as a lightweight metal or plastic disc 39. This enables the front wheel to act as a rudder for guiding the marine bicycle. The disc 39 is substantially flush with the wheel 12, not interfering with the bicycle's fork 40, and it may be secured by any suitable means such as bolts, U-bolts, etc. to the spokes of the wheel. Of course, the disc may be a permanent fixture, since it need not be removed during normal use of the bicycle, and to this end it may comprise an integral part of the wheel 12, eliminating spokes.

The rear wheel 13 is the propelling wheel, and includes impeller vanes or cups 41 having their concave sides oriented to push water back and propel the vehicle forward when the impeller vanes are in the lower portion of their revolution. The vanes 41 may comprise elongated members extending radially, through most of the length of the rear wheel spokes, as shown in FIGS. 1 and 3, or may themselves act as spokes, extending from the hub to the rim. This shape confines the impeller vanes to substantially the width of the rear wheel, or a slightly greater width, so that they do not strike and are not impeded by the bicycle frame, fender braces, etc. Alternatively, other forms of impeller cups may be used, and may be staggered side-to-side to a greater extent than are the spokes themselves. If the illustrated elongate vanes are used, they may be connected to the spokes of the rear wheel 13 as shown in FIG. 4, by small U-bolts 42 which tightly engage the spokes 43 and prevent rotation of the vanes 41 with respect to the spokes, or by welding or soldering, since the vanes need not be removed during land use of the vehicle.

Since there is some upward lifting of water and splashing associated with the impeller vanes 41 when the marine bicycle is pedalled forward, the bicycle may include a widened rear fender or rear portion 44 of the rear fender, as shown in FIG. 1. Such a splash guard is simple lightweight, inexpensive and not unattractive.

FIG. 2 shows, in dashed lines, elevating blocks 46 which may be used on a floor or other surface to raise the floats 19 sufficiently to bring the front and rear tires 12 and 13 above the surface, so that the bicycle 11 can be used as a stationary exercising device. An exercising resistance device 47, as shown in dashed lines in FIG. 2, may be engaged against the rear wheel of the bicycle to provide the desired resistance. Such as exercising resistance device 47 may be connected onto the floats 19 or simply positioned on the surface in such a way as to be engaged by the rear wheel 13. In this way, the float attachment 18 of the amphibious bicycle 10 provides a simple means of converting a bicycle into an exercising device. A bicycle without the float attachments does not have this capability, since it has no convenient appendage for supporting the rear wheel at an elevated position. Of course, in the arrangement of FIG. 2 the front wheel 12 may simply rest on the surface, with only the rear portion and rear wheel 13 of the bicycle elevated.

FIG. 5 shows an alternate form of float 50, which is inflatable via a nozzle 51, with a rigid saddle device 52 providing support for connection of the float frame members 21 and 22. Straps 53 may be provided to connect the saddle member 52 securely to the inflatable float 50. The rigid saddle member 52 also provides a step for the user to mount the bicycle, as does the rigid surface member 24 of the first described embodiment.

The inflatable floats 50 may be deflated, if desired, when the bicycle is used for land operation.

The amphibious attachment described adds relatively little weight to the bicycle. The front wheel disc 39 is thin and of lightweight material, and the impeller vanes 41 on the rear wheel may also be very light, making these components practically negligible in their effect on total weight. The floats are of very lightweight material, and the structural frame members 21, 22 and 28 may be of aluminum or other lightweight metal, resulting in a total added weight which may be only about fifty pounds or even less.

The above described preferred embodiments provide an amphibious bicycle, and an attachment for converting a bicycle to amphibious use, with maximum utilization of the existing bicycle components and with a lightweight and non-obstructive float attachement which may be readily removed. The converted bicycle is versatile in being capable of use on land or in water without adjustment, and the described apparatus has been proven in tests to work efficiently, and is an economically feasible arrangement for making a conventional bicycle amphibious. Various other embodiments and variations to these preferred embodiments will be apparent to those skilled in the art and may be made without departing from the spirit and scope of the invention as defined by the following claims.

I claim:

1. An amphibious attachment capable of fitting a wide variety of sizes and styles of bicycles, comprising:

a pair of elongated floats spaced apart to accomodate a bicycle frame and wheels between them, the floats extending substantially the entire length of a bicycle and each being unitary and continuous throughout such length;

a pair of transverse frame members connecting the floats at forward and rearward locations and maintaining the floats rigidly in spaced relationship, each transverse frame member comprising a generally vertical member extending up from each float and a generally horizontal member spanning between and affixed to the tops of the vertical members, each vertical member having a threaded portion extending to its lower end and taller than the height of a float, with two nuts engaged on each threaded portion;

the floats each including two longitudinally slotted openings extending through the height of the float, with the threaded portion of one of said vertical members extending through each slotted opening, one nut above and one below the float at each opening, engaged against the top and bottom of the float, so that the relative fore-and-aft position of each transverse frame member with respect to the floats and therefore the separation between the frame members can be adjusted by movement within the slotted openings and so that the height of each transverse frame member with respect to the floats can be adjusted by raising or lowering the nuts, thereby facilitating connection to different sizes and configurations of bicycles;

centrally positioned front connecting means on the forward transverse frame member for removably connecting it to the front fork-retaining sleeve of the bicycle frame, including means for accommodating various configurations of bicycle frames;

centrally positioned rear connecting means on the rearward transverse frame member for removably connecting it to a generally upright member of the bicycle frame, below the seat, including means for accommodating various configurations of bicycle frames;

a rigid circular disc and means for mounting it substantially flushly on the front wheel of the bicycle, within the space encompassed by the front wheel rim, so that the front wheel becomes a steerable rudder; and a series of impeller vanes and means for mounting them on the rear wheel of the bicycle, so that the rear wheel becomes a propelling means;

whereby the amphibious attachment may be fitted to nearly any bicycle of conventional configuration, adapting it for use in water, suspended by the floats with the front and rear wheels partially submerged, so that the bicycle may be propelled by pedalling and steered by steering of the front wheel.

2. The amphibious attachement for bicycles of claim 1, wherein the impeller vanes comprise elongated concave strips of length adapted to extend most of the length of the rear wheel spokes of a bicycle, and wherein said impeller vane mounting means comprises means associated with each vane for clamping the vane on a rear wheel spoke.

* * * * *